US009026360B2

(12) United States Patent
Fries et al.

(10) Patent No.: US 9,026,360 B2
(45) Date of Patent: May 5, 2015

(54) SYSTEMS AND METHODS FOR PROVIDING CONSTANT WARNING TIME AT CROSSINGS

(71) Applicant: General Electric Company, Schenectady, NY (US)

(72) Inventors: Jeffrey Michael Fries, Melbourne, FL (US); Jeffrey Baker, Overland Park, KS (US); Aric Albert Weingartner, Lee's Summit, MO (US); Michael Steffen, II, Melbourne, FL (US); Jesse Lee Herlocker, Melbourne, FL (US); William Shields, Blue Springs, MO (US)

(73) Assignee: General Electric Company, Schenectady, NY (US)

( * ) Notice: Subject to any disclaimer, the term of this patent is extended or adjusted under 35 U.S.C. 154(b) by 23 days.

(21) Appl. No.: 13/910,412

(22) Filed: Jun. 5, 2013

(65) Prior Publication Data

US 2014/0361125 A1 Dec. 11, 2014

(51) Int. Cl.

| | |
|---|---|
| ***G01S 1/00*** | (2006.01) |
| ***B61L 1/02*** | (2006.01) |
| ***G08G 1/16*** | (2006.01) |
| ***B61L 29/04*** | (2006.01) |

(52) U.S. Cl.

CPC ..... *B61L 29/04* (2013.01)

(58) Field of Classification Search

USPC ..... 701/408–541; 246/126; 340/903

See application file for complete search history.

(56) References Cited

U.S. PATENT DOCUMENTS

| | | | | |
|---|---|---|---|---|
| 4,942,395 | A * | 7/1990 | Ferrari et al. | 340/907 |
| 5,098,044 | A * | 3/1992 | Petit et al. | 246/187 A |
| 5,864,304 | A * | 1/1999 | Gerszberg et al. | 340/903 |
| 6,218,961 | B1 * | 4/2001 | Gross et al. | 340/903 |
| 6,662,106 | B2 * | 12/2003 | Evans | 701/415 |
| 6,824,110 | B2 * | 11/2004 | Kane et al. | 246/293 |
| 7,089,093 | B2 * | 8/2006 | Lacote et al. | 701/19 |
| 7,729,819 | B2 * | 6/2010 | Rajaram | 701/19 |
| 7,966,126 | B2 | 6/2011 | Willis | |
| 8,214,091 | B2 * | 7/2012 | Kernwein | 701/19 |
| 8,406,940 | B2 | 3/2013 | Otsubo | |
| 8,469,319 | B2 * | 6/2013 | Kiss et al. | 246/125 |
| 2008/0162027 | A1 * | 7/2008 | Murphy et al. | 701/117 |
| 2009/0177344 | A1 * | 7/2009 | James et al. | 701/19 |
| 2011/0084176 | A1 | 4/2011 | Reichelt | |
| 2011/0133038 | A1 * | 6/2011 | Kiss et al. | 246/126 |
| 2013/0193275 | A1 * | 8/2013 | Baines et al. | 246/111 |

* cited by examiner

*Primary Examiner* — Thomas G Black
*Assistant Examiner* — Tyler Paige
(74) *Attorney, Agent, or Firm* — GE Global Patent Operation; John A. Kramer

(57) ABSTRACT

A system includes a determination module and a communication module. The determination module is configured to be located onboard a first vehicle configured to travel along a first route including a crossing corresponding to an intersection of the first route with a second route. The determination module is configured to be communicatively coupled with a remote crossing module. The determination module is configured to determine, based on a speed of the first vehicle, timing information corresponding to a time at which the first vehicle will travel proximate to the crossing on the first route. The communication module is configured to transmit the timing information to the remote crossing module. The timing information includes a reference time configured as an absolute time corresponding to a time for impeding travel of a second vehicle along the second route through the crossing.

20 Claims, 3 Drawing Sheets

SYSTEMS AND METHODS FOR PROVIDING CONSTANT WARNING TIME AT CROSSINGS

FIELD

Embodiments of the subject matter described herein relate to vehicle location systems and methods, and more particularly, to systems and methods for providing constant or consistent warning times at crossings.

BACKGROUND

A rail vehicle transportation system may include tracks over which rail vehicles travel. These tracks may cross routes of other transportation systems, such as road or highway systems over which automobile traffic may pass. To warn automobiles, crossing gates may be provided at locations where the tracks intersect roads, with the crossing gates configured to warn motorists and inhibit automobiles from crossing the tracks while a rail vehicle is traveling on the tracks at or near the crossing.

Some known railroad crossings use a warning predictor track circuit that detects motion of a train towards the crossing. Warning predictors may calculate the time of train arrival to the crossing based on the detected motion, and activate the crossing warning devices (lights, gates, bells, or the like) a specified minimum amount of time prior to train arrival at the crossing. The minimum amount of time may be set by a government regulation, or set to exceed a government regulation. Crossing predictors are commonly used where there are mixed train types (freight, passenger, or the like) and/or where train speeds vary dramatically.

In some systems, for example rail systems that use catenaries or third rails to provide energy to rail vehicles, electrical interference may be too high for predictor systems to function accurately. Thus, in some applications, crossing gates or lights may be activated based on train occupancy within a given distance of a crossing, without respect to relative speed or arrival time of a train at a crossing. If track circuits that simply activate the crossing based on train occupancy are used (as opposed to detecting train motion), the warning times provided at the crossing can vary significantly depending upon train speed. Long warning times are undesirable because of the unnecessary delay caused to motorists, and also because overly long warning times may tempt impatient motorists to drive around crossing gates and/or disregard audible or visible warnings if the motorists do not see any trains approaching after some period of time.

Traditional predictor track circuits are limited by practical considerations to a range extending a given distance from a crossing. Thus, rail vehicles may travel at a speed that exceeds that predictor track circuit's ability to detect the rail vehicle's presence in time to lower a gate within a desired time range. Some systems account for such speeds exceeding the predictor track circuit's ability by sending a message from the rail vehicle when traveling at such higher speeds before encountering the effective range of the predictor track circuit, with the message conveying a relative time (from the time the message was sent) when the rail vehicle is expected to arrive at the crossing. Delays in sending, receiving, and/or processing the message with the relative time require that the crossing be designed to close at a time exceeding a desired time for closing, in order to account for worst case delays, which may be around ten seconds or more. In such systems, crossings will frequently activate earlier than desired, resulting in overly long waiting periods, and resulting in inconsistent wait times for motorists. Such systems also fail to address issues resulting from relatively slower speeds.

BRIEF DESCRIPTION

In one embodiment, a system includes a determination module and a communication module. As used herein, the terms "system" and "module" include a hardware and/or software system that operates to perform one or more functions. For example, a module or system may include a computer processor, controller, or other logic-based device that performs operations based on instructions stored on a tangible and non-transitory computer readable storage medium, such as a computer memory. Alternatively, a module or system may include a hard-wired device that performs operations based on hard-wired logic of the device. The modules shown in the attached figures may represent the hardware that operates based on software or hardwired instructions, the software that directs hardware to perform the operations, or a combination thereof.

The determination module is configured to be located onboard a first vehicle configured to travel along a first route. The first route includes a crossing corresponding to an intersection of the first route with a second route. The determination module is configured to be communicatively coupled with a remote crossing module configured to impede travel of a second vehicle along the second route through the crossing when the first vehicle is proximate to the crossing on the first route. The first vehicle may be understood as being proximate to the crossing when the first vehicle is at or near the crossing, for example within a specified range of the crossing corresponding to a safety rule or regulation (e.g., within 20 seconds of arrival at the crossing, within 30 seconds of arrival at the crossing, or the like). The determination module is configured to determine, based on a speed of the first vehicle, timing information corresponding to a time at which the first vehicle will travel proximate the crossing. The communication module is configured to communicatively couple the determination module to the remote crossing module, and to transmit the timing information to the remote crossing module. The timing information includes a reference time corresponding to a time for impeding travel of the second vehicle along the second route through the crossing, and is configured as an absolute time.

In another embodiment, a system includes a remote crossing module configured to be disposed along a first route along which a first vehicle is configured to travel. The first route includes a track and a crossing corresponding to an intersection of the first route with a second route. The remote crossing module is configured to impede travel by a second vehicle along the second route through the crossing when the first vehicle is proximate the crossing. The remote crossing module includes a communication module, a determination module, and an automatic closure module. The communication module is configured to communicatively couple the remote crossing module to the first vehicle and to receive timing information from the first vehicle. The timing information includes a reference time corresponding to a time for impeding travel of the second vehicle along the second route through the crossing, with the reference time configured as an absolute time. The determination module is configured to determine a closing time to impede travel along the second route using the timing information. The automatic closure module configured to impede travel along the second route using information obtained from a track detection system configured to detect signals sent via the track.

In another embodiment, a method includes determining, at a processing unit disposed onboard a first vehicle configured to travel along a first route, timing information corresponding to a time at which the first vehicle will travel proximate a crossing based on a speed of the first vehicle. The crossing corresponds to an intersection of the first route with a second route. The method also includes communicating the timing information to a remote crossing module disposed along the first route proximate the crossing. The remote crossing module is configured to impede travel along the second route by a second vehicle through the crossing when the first vehicle is proximate the crossing. The timing information includes a reference time configured as an absolute time corresponding to a time for impeding travel along the second route through the crossing.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
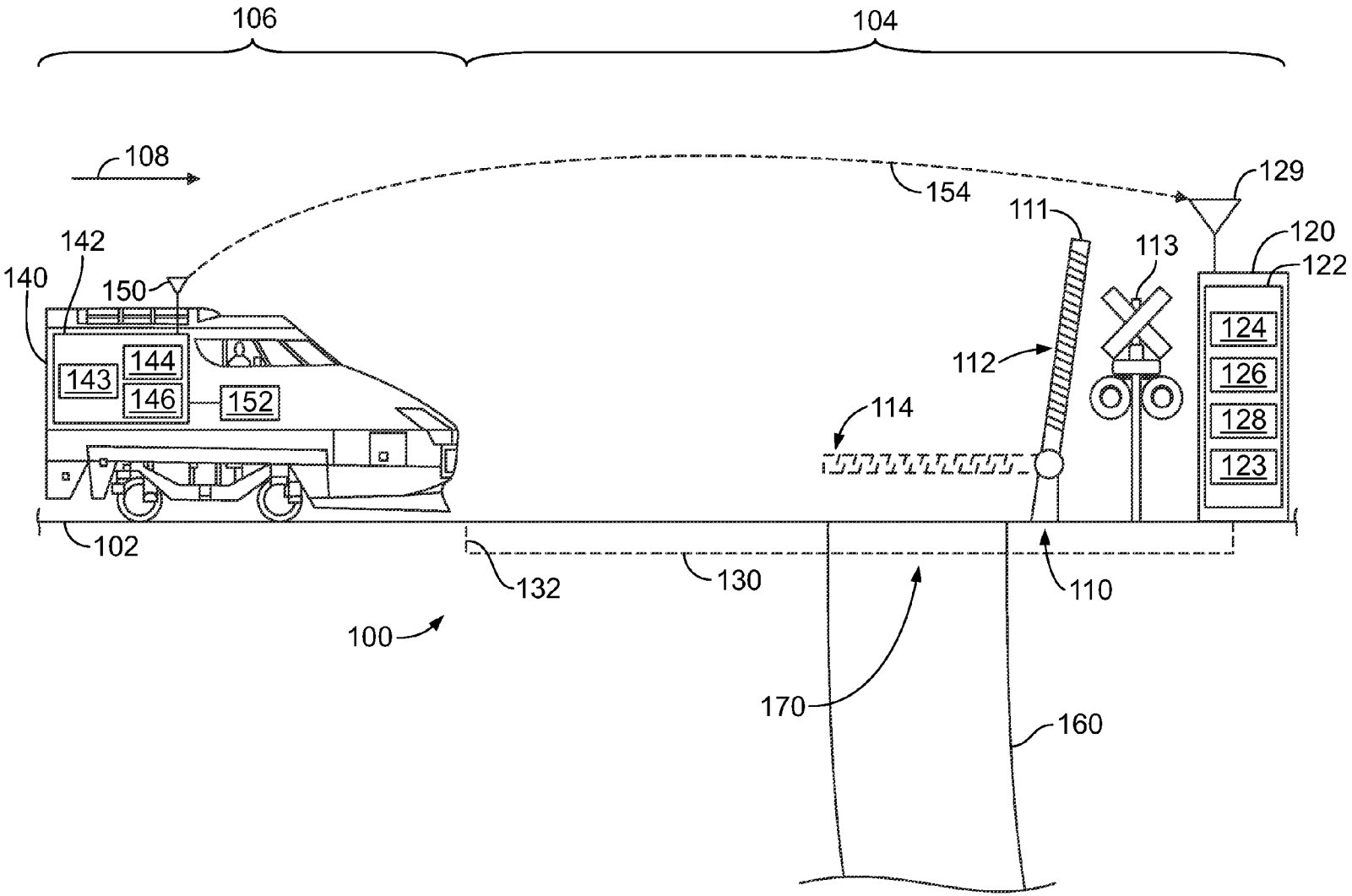
FIG. 1 is a schematic view of a transportation system in accordance with an embodiment.

One or more embodiments of the inventive subject matter described herein provide systems and methods for improved operation of crossings for transportation systems, such as crossings associated with an intersection between a rail system and a road or highway system. In various embodiments, an onboard system is provided that is configured to control movement of a rail vehicle and to communicate with a remote crossing module, such as wayside equipment controlling the crossing. The control systems for the rail vehicle, for example, may be configured to be compatible with Positive Train Control (PTC) systems utilized in the United States. In various embodiments, bidirectional communications between onboard equipment and wayside equipment may be used to activate and deactivate crossing warning (or closing) systems only when necessary to provide a substantially consistent amount of warning time. In various embodiments, an onboard system is configured to communicate an arrival time at a crossing (or a time to initiate warning or closing of a crossing) regardless of the speed at which the rail vehicle is traveling. This time may also be used to preemptively clear out traffic from an intersection prior to closing the crossing. The time may be communicated before the rail vehicle enters an effective range of an automatic closing (or warning) system. In various embodiments, an absolute time is communicated to the remote crossing module (e.g., wayside equipment), so that crossing activation may be accomplished consistently and without having to factor in delay times to account for sending a message, receiving a message, or the like.

A technical effect of embodiments includes reduction of delays in operating crossing activation systems. A technical effect of embodiments includes improved consistency in warning times provided at crossings, for example to motorists encountering a rail crossing. A technical effect of embodiments includes reduction of inconvenience and/or confusion to motorists or others at a crossing. A technical effect of embodiments is the reduction of temptation to motorists to drive around a closed gate at a crossing, disregard a warning provided at a crossing, or engage in other unsafe behavior. A technical effect of embodiments is the reduction of accidents at crossings. A technical effect of embodiments is the improvement of crossing gate and/or warning systems in conjunction with electrified systems for which predictor circuits may not be employed effectively. A technical effect of embodiments is the operation of crossing warning systems without requiring the use of approach track detection circuits (in various embodiments where an approach circuit is not used, an island circuit may still be utilized). A technical effect of embodiments is the improvement of crossing gate or warning activation at relatively slower vehicle speeds and/or reduction of gate pump.

Throughout this document, the term vehicle consist may be used. A vehicle consist is a group of any number of vehicles that are mechanically coupled to travel together along a route. A vehicle consist may have one or more propulsion-generating units (e.g., vehicles capable of generating propulsive force, which also are referred to as propulsion units) in succession and connected together so as to provide motoring and/or braking capability for the vehicle consist. The propulsion units may be connected together with no other vehicles or cars between the propulsion units. One example of a vehicle consist is a locomotive consist that includes locomotives as the propulsion units. Other vehicles may be used instead of or in addition to locomotives to form the vehicle consist. A vehicle consist can also include non-propulsion generating units, such as where two or more propulsion units are connected with each other by a non-propulsion unit, such as a rail car, passenger car, or other vehicle that cannot generate propulsive force to propel the vehicle consist. A larger vehicle consist, such as a train, can have sub-consists. Specifically, there can be a lead consist (of propulsion units), and one or more remote consists (of propulsion units), such as midway in a line of cars and another remote consist at the end of the train. The vehicle consist may have a lead propulsion unit and a trail or remote propulsion unit. The terms "lead," "trail," and "remote" are used to indicate which of the propulsion units control operations of other propulsion units, and which propulsion units are controlled by other propulsion units, regardless of locations within the vehicle consist. For example, a lead propulsion unit can control the operations of the trail or remote propulsion units, even though the lead propulsion unit may or may not be disposed at a front or leading end of the vehicle consist along a direction of travel. A vehicle consist can be configured for distributed power operation, wherein throttle and braking commands are relayed from the lead propulsion unit to the remote propulsion units by a radio link or physical cable. Toward this end, the term vehicle consist should be not be considered a limiting factor when discussing multiple propulsion units within the same vehicle consist.

FIG. 1 depicts a schematic view of a transportation system 100 in accordance with one embodiment. The system 100 includes a crossing warning system 110, a remote crossing module 120, a track detection system 130, and a vehicle system 140. In the embodiment depicted in FIG. 1, the vehicle system 140 is shown traveling over a first route 102 in a direction 108 toward a crossing 170. The crossing 170 corresponds to intersection of the first route 102 with a second route 160. The first route 102, for example, may be configured as a railroad track over which a rail vehicle may travel. The second route 160 in the illustrated embodiment is a road or highway that is paved, leveled, or otherwise configured for automobile and/or truck travel. In some embodiments, the crossing may be understood as a "highway crossing at grade."

The crossing warning system 110 and the remote crossing module 120 are associated with and disposed proximate the crossing 170. The crossing warning system 110 and the remote crossing module 120 are configured to impede access through the crossing 170 via the second route 160 (e.g., paved road accessible to automobiles) when the vehicle system 140 passes by or through the crossing 170 along the first route 102 (e.g., rail system).

The track detection system 130 depicted in FIG. 1 has an effective range 104. In FIG. 1, the vehicle system 140 is depicted in a territory 106 outside of the effective range 104 and moving in direction 108 toward the crossing 170 and toward entering the effective range 104 of the track detection system 130.

It should be noted that FIG. 1 is schematic in nature and intended by way of example. In various embodiments, various aspects or modules may be omitted, modified, or added. Further, various modules, systems, or other aspects may be combined. Yet further still, various modules or systems may be separated into sub-modules or sub-systems and/or functionality of a given module or system may be shared between or assigned differently to different modules or systems.

The depicted crossing warning system 110 is configured to impede travel through the crossing 170 along the second route 160 when the crossing warning system 110 is activated. The crossing warning system 110, when activated, may provide one or more of an audible warning (e.g., bell), visible warning (e.g., flashing lights), and/or a physical barrier (e.g., gate). In the illustrated embodiment, the crossing warning system 110 includes a gate 111 that may be raised to an open position 112 to allow traffic through the crossing 170 along the second route 160 or lowered to a closed position 114 to impede traffic through the crossing 170 along the second route 160. The depicted crossing warning system 110 also includes a crossing warning indicator 113 configured to provide a visual and/or audible indication. In various embodiments, the crossing warning indicator 113 may include one or more of lights, bells, or the like. In some embodiments, as used herein, impeding travel along a particular route may not present an absolute bar to travel along the route. For example, travel along a route may be impeded by warning against travel through a crossing, discouraging travel through a crossing, blocking travel through a crossing, instructing against travel through a crossing, or otherwise inhibiting travel through a crossing. For instance, the gate 111 may be placed in the closed position 114 to impede the passage of traffic through the crossing 170 along the second route 160; however, a motorist may attempt to evade the gate 111 by driving around the gate 111. Similarly, a motorist may ignore warning bells or lights. Various embodiments provide improved consistency in warning times to reduce the temptation of motorists to evade or ignore a crossing warning.

In the illustrated embodiment, the remote crossing module 120 is disposed along the route 102 along which the vehicle 140 is configured to travel proximate to the crossing 170. The remote crossing module is operably connected to the crossing warning system 110 and is configured to operate the crossing warning system 110 to allow traffic through the crossing 170 along the second route 160 when no vehicles are traversing through the crossing 170 along the first route 102 (or are within a specified time and/or distance of the crossing 170), and to impede traffic through the crossing 170 along the second route 160 when a vehicle is traversing through the crossing 170 along the first route 102 (or is within a specified time and/or distance of the crossing 170). The remote crossing module 120 may operate the crossing warning system 110 based on instructions or information received from one or more of the vehicle system 140 or the track detection system 130. The remote crossing module 120 depicted in FIG. 1 includes a processing unit 122 and an antenna 129. In various embodiments, the remote crossing module 120 may be configured as wayside equipment.

The processing unit 122 of the illustrated embodiment includes a memory 123, a communication module 124, a crossing determination module 126, and an automatic closure module 128. In the illustrated embodiment, the communication module 124 is configured to wirelessly receive messages from and/or transmit messages to the vehicle system 140 via the antenna 129. In alternate embodiments, the communication module 124 (and the communication module 146 of the vehicle system 140) may be configured to communicate over different media, such as over one or more rails of the transportation system 100. The crossing determination module 126 is configured to determine an activation time to activate the crossing warning system 110 and to activate or deactivate the crossing warning system 110 based on the presence of a vehicle along the first route 170 at or near the crossing 170 (e.g., within a specified closing or warning time or distance). It should be noted that FIG. 1 is intended by way of example and is schematic in nature. In various embodiments, various modules (or portions thereof) of the processing unit 122 may be added, omitted, arranged differently, or joined into a common module, various portions of a module or modules may be separated into other modules or sub-modules and/or be shared with other modules, or the like.

The communication module 124 is configured to communicate messages or information with the vehicle system 140. The communication module 124 may be configured to one or more of receive messages, transmit messages, pre-process information or data received in a message, format information or data to form a message, decode a message, decrypt or encrypt a message, compile information to form a message, extract information from a message, or the like. In the illustrated embodiment, the communication module 124 utilizes the antenna 129 to communicate with the vehicle system 140. For example, the communication module 124 may receive a message 154 transmitted from the vehicle system 140 via the antenna 129. As discussed herein, the message 154 may be transmitted before the vehicle system enters the range 104 and may include information corresponding to one or more of a time to activate the crossing warning system 110, suppression of an activation of the crossing warning system 110 indicated by the track detection system 130, or identification of a sub-route upon which the vehicle system 140 is traveling.

For example, the message 154 may include timing information that includes a reference time corresponding to a time for impeding travel along the second route through the crossing. In various embodiments, the reference time may be a time at which the vehicle system 140 is projected to arrive at the crossing 170. In various embodiments, the reference time may be a time at which the remote crossing module 120 is to activate the crossing warning system 110 (e.g., a time a predetermined amount before the time at which the vehicle system 140 arrives at or passes through the crossing 170). In the illustrated embodiment, the reference time is an absolute time. An absolute time may be understood as a time specified in accordance with a synchronization scheme where other entities use the same scheme. For example, clocks associated with and/or accessible by both the vehicle system 140 and the remote crossing module 120 may be synchronized via a common precision time reference such as a time provided by a global positioning system (GPS) or Network Time Protocol (NTP). In contrast to an absolute time, a relative time may be understood as a time described with reference to a particular event (e.g., 30 seconds from a time of receiving a message, 20 seconds from a time of receiving a message, or the like).

In various embodiments, use of an absolute time, in contrast to a relative time, helps provide more consistent warning times and/or avoids delays to motorists and/or overly long warning or closure periods. For example, use of a relative time requires the factoring in of additional time to account for delays in transmission, reception, and/or comprehension of a message. By way of example, a communication system may have a worst case delay of about ten seconds for sending, receiving, and comprehending a message indicating a closing time for a crossing gate. To meet a desired time for activation or closing of the gate therefore, about ten seconds must be added to the desired time, to ensure that the desired time is met in worst case delay scenarios. Thus, for a system with a 10 second worst case delay for messaging, the activation time must be set at least 10 seconds early to account for the worst case delay. Because the worst case delay is generally not the most common case, the crossing warning or closure will thus be frequently activated earlier than desired. For example, in cases where there is little or no delay in messaging, the crossing warning will be activated about ten seconds early. If there are about two seconds of messaging delay, the crossing warning will be activated about eight seconds early. Thus, the crossing warning for systems utilizing a relative time may provide motorists with inconsistent warning times and/or inappropriately lengthy crossing closures. In various embodiments, use of timing information configured in terms of an absolute time does not require accounting for messaging delay, and reduces or eliminates such inconsistency and/or delay.

In various embodiments, information regarding track occupancy, status of switches, or other information utilized, for example, in conjunction with a positive control system may be exchanged between the remote crossing module 120 and the vehicle system 140. A positive train control system may be understood as a system for monitoring and controlling the movement of a rail vehicle such as a train to provide increased safety. A train, for example, may receive information about where the train is allowed to safely travel, with onboard equipment configured to apply the information to control the train or enforce control activities in accordance with the information. For example, a positive train control system may force a train to slow or stop based on the condition of a signal, switch, crossing, or the like that the train is approaching.

As indicated above, in the illustrated embodiment, the crossing determination module 126 is configured to determine an activation time to activate the crossing warning system 110, and to activate or deactivate the crossing warning system 110 based on the presence (or absence) of a vehicle traversing the first route 102 at or near the crossing 170 (e.g., within a specified closing or warning time or distance). Activation of the warning crossing system 110 may include one or more of closing a gate, providing flashing lights, sounding an alarm (e.g., bells), or the like. In various embodiments, the crossing determination module 126 may determine a time to activate (or deactivate) the crossing warning system 110 based on information received from one or more of the vehicle system 140 or the automatic closure module 128.

As one example, timing information including a reference time (configured as an absolute time as discussed herein) may be provided as part of the message 154. The reference time may be specified in some embodiments as a time to activate the warning crossing system 110. In some embodiments, the reference time provided as part of the message 154 may be specified as a time (e.g., an absolute time) when the vehicle system 140 will arrive at the crossing 170. The crossing determination module 126 may then determine a time to activate the crossing 170 based on the reference time (e.g., arrival time). The determination may be made using a predetermined buffer time between the activation of the crossing warning system 110 and the arrival of the vehicle system 140 at the crossing 170. For example, if it is desired that the crossing warning system 110 be activated 20 seconds before the vehicle system 140 arrives at the crossing, then the crossing determination module 126 may determine an activation time to activate the crossing warning system 110 of 20 seconds prior to the arrival time provided via the message 154. As another example, if it is desired that the crossing warning system 110 be activated 30 seconds before the vehicle system 140 arrives at the crossing, then the crossing determination module 126 may determine an activation time of 30 seconds prior to the arrival time.

In the illustrated embodiment, the automatic closure module 128 is configured to impede travel along the second route 160 using information obtained from the track detection system 130. The automatic closure module 128 is operably coupled to and receives information from the track detection system 130, and operates the crossing warning system 110 using information from the track detection system 130. As discussed herein, the track detection system 130 (and/or the automatic closure module 128 in conjunction with the track detection system 130) may be configured to send an electrical signal into a track (e.g., route 102) and receive or detect a signal corresponding to an occupancy or activity on the track. In various embodiments, the automatic closure module 128 may provide redundancy or a back-up to the timing determination module 126.

For example, if the vehicle system 140 is moving at a speed that exceeds the ability of the automatic closure module 128 to activate the warning crossing system 110, the vehicle system 140 may send timing information to the remote crossing module 120, and the timing determination module 126 may determine a time to activate the warning crossing system 110 before the vehicle system 140 enters the range 104 of the track detection system 130 or automatic closure module 128. However, if the communication module 124 does not receive timing information (or suppression information) from the vehicle system 140, or if the timing determination module 126 receives timing information but is unable to process the received information and activate the crossing warning system 110, then the automatic closure module 128 may operate the closing warning system 110.

As another example, if the vehicle system 140 is moving at a relatively lower speed for which operation of the automatic closure module 128 would result in an overly long time gap between activation and arrival of the vehicle system 140 at the crossing 170, the vehicle system 140 may send suppression information along with the timing information to the remote crossing module 120. The timing determination module 126 may then determine a time to activate the warning crossing system 110, with the activation time occurring after the vehicle system 140 enters the range 104 of the track detection system 130 or automatic closure module 128, and the remote crossing module 120 may ignore information from the track detection system 130 and/or suppress a corresponding activation otherwise indicated by the track detection system 130 and/or automatic closure module 128. However, if the communication module 124 does not receive timing information (or suppression information) from the vehicle system 140, or if the timing determination module 126 receives suppression and timing information but is unable to process the received information and activate the crossing warning system 110, then the automatic closure module 128 may operate the closing warning system 110. Further, some vehicles traversing a route (e.g., route 102) may be configured to provide timing and/or suppression information to the remote crossing module 120, while other vehicles utilizing the same transportation network may not be so equipped. Thus, for example, the automatic closure module 128 and track detection system 130 may be employed in conjunction with vehicles not so equipped, and the timing determination module 126 may be employed in conjunction with vehicles that are so equipped.

As indicated above, in the illustrated embodiment, the automatic closure module 128 is operably coupled with the track detection system 130. Generally, in various embodiments, the automatic closure module 128 works in conjunction with the track detection system 130. The depicted automatic closure module 128 is configured to operate the crossing warning system 110 based on information detected through the route 102. The automatic closure module 128, in conjunction with the track detection system 102 may be configured to close a gate or otherwise initiate a warning as a vehicle approaches the crossing 170 along the first route 102 and/or to open a gate or otherwise terminate a warning after a vehicle has passed through the crossing 170 along the first route 102. In some embodiments, the track detection system 130 may be configured as a crossing predictor system that provides information corresponding to both a position along the route 102 and a speed of the vehicle system 140. In some embodiments, the track detection system 130 may be configured as an occupancy detection system that only provided information regarding whether the vehicle system 140 is present along a given portion of the route 102 or not.

As depicted in FIG. 1, the track detection system 130 has a range 104. In the illustrated embodiment, the track detection system 130 includes a detection element 132 that defines the boundary of the range 104. The detection element 132, for example, may be a shunt buried beneath a track and operably connecting adjacent rails for completing or defining a circuit for a signal sent via a crossing predictor system or directing the signal along a track or rail (e.g., route 102). The range 104 corresponds to the distance at which the track detection system is able to detect or determine the presence of the vehicle system 140. The range 104 defines or corresponds to a reference speed that is the maximum speed at which the vehicle system 140 may travel for which the automatic closure module 128 and/or track detection system 130 is able to detect the vehicle system 140 and activate the warning crossing system in time to meet a standard, mandated, or otherwise desired time for activation before the arrival of the vehicle system 140 at the crossing 170. In FIG. 1, the range 104 is depicted for ease of illustration as extending in one direction (e.g., to the left of the crossing as seen in FIG. 1), but it should be understood that the range 104 may also extend in the opposite direction (e.g., to the right of the crossing as seen in FIG. 1) to provide for traffic detection in multiple directions.

As indicated above, the track detection system may be configured as a crossing predictor system. Crossing predictors may be used to attempt to determine a time of arrival at a crossing by a vehicle. Known crossing predictor systems may use alternating current (AC) track circuits to determine the rate of change of impedance in an area of track near a crossing. The area near the crossing may be referred to as an approach. Such an approach may be hundreds or thousands of feet on either side of a crossing. As a vehicle such as a train moves toward the crossing, the axles of the train act to shunt the AC track circuit signal, shortening the distance that the signal flows through. The crossing predictor (e.g., one or more portions or aspects of the track detection system 130 and/or automatic determination module 128) measures a rate of change of the electrical impedance indicated by the signal, and estimates the speed of location of the train based on the measured electrical impedance, and estimates a predicted arrival time of the vehicle at the crossing based on the determined speed and position, and a crossing warning device may then be activated at a predetermined time interval before the predicted arrival time. Such systems are not without shortcomings, however. For example, such systems may not accurately provide adequate warning time for a vehicle that makes changes in speed after the crossing predictor system detects the vehicle and predicts an arrival time. The crossing warning may be activated too early if the vehicle slows down after the crossing prediction predicts the arrival time, or may be activated too late if the vehicle speeds up after the crossing prediction predicts the arrival time.

Further still, crossing predictor systems do not function properly when a relatively large amount of electrical interference is present, such as electrical interference present in electrified systems. In such electrified systems, vehicles such as trains may be powered by AC or direct current (DC) power provided by an overhead catenary, third rail, or the like. The currents provided to power the vehicles may exceed hundreds or thousands of amperes, and are much larger than currents used by crossing predictor systems. The large difference in signal amplitudes between the electrification currents used to power vehicles and the currents used for crossing predictors may make it difficult to separate the signals when the electrification and predictor currents are shared on the same rail conductors or in close proximity to each other. Further, interference frequencies from the electrification currents may, for example, cause activation via crossing predictors when no vehicles are present, leading to confused motorists and/or motorists evading crossing gates or engaging in other unsafe behavior. Also, in such electrification systems, there may be impedance bonds between adjacent rails configured to balance the flow of electrification currents between rails to improve safety by reducing hazardous voltages that may develop between the rails. Such impedance bonds may cause errors in the impedance calculations used by the crossing predictors used to predict arrival time of vehicles at the crossing. As a result, crossing predictors may not be employed in electrified territories.

Instead, electrified systems may employ occupancy detection circuits or systems. Such occupancy detection track circuits may detect the presence of a train or other vehicle along a route within a given distance of a crossing, but do not detect or determine information corresponding to a more precise position and/or speed of a vehicle. For such systems, a length of approach may be designed to provide the minimum desired or required amount of warning time at the maximum authorized vehicle speed. The length of approach may also be limited by practical considerations, such as the attenuation of a signal along the tracks. By of example, if the maximum authorized speed is 50 miles per hour, and 30 seconds of warning time is desired, than the range (e.g., the distance at which the vehicle is detected) of the track detection system would need to be 2200 feet or longer. (50 miles/hour×1 hour/60 minutes×1 minute/60 seconds×30 seconds×5280 feet/mile=2200 feet.) However, for a train traveling only 25 miles per hour toward the same crossing, the train's presence would be detected (and the crossing warning activated) 60 seconds before the arrival of the train at the crossing, resulting in a warning or closure time twice as long as necessary or desired.

Motorists waiting such extended periods of times and/or experiencing such inconsistent warning times may grow impatient and attempt to evade or disregard warnings or closure, resulting in potentially dangerous situations.

Thus, warning times determined by the automatic closure module 128 and track detection system 130 may suffer inconsistency and/or inaccuracy due to a number of causes, depending, for example, on one or more of type of track detection system, delays in messaging, relatively high speed of vehicle approaching crossing, relatively low speed of vehicle approaching crossing, changes in speed of vehicle approaching crossing, or the like. In various embodiments, the remote crossing module 120 may preferentially select an activation time provided by the crossing determination module 126 using information including timing information configured in terms of an absolute time provided by the vehicle system 140 to an activation time indicated by a crossing predictor system. In various embodiments, the remote crossing module 120 may operate the warning crossing system 110 in accordance with information received from the vehicle system 140 when information is received from the vehicle system 140, and operate the warning crossing system 110 in accordance with information received from the track detection system 130 when information is not received from the vehicle system 140 (e.g., if communication module of vehicle system or remote crossing module is not functioning properly, if a given vehicle system is not configured to provide information for operating the warning crossing system, or the like).

The vehicle system 140 is configured to travel along the first route 102. In FIG. 1, the vehicle system 140 is positioned in the territory 106 outside of the range 104 of the track detection system 130, and is traveling in a direction 108 toward the crossing 170. The vehicle system 140 may be, for example, a rail vehicle. In the illustrated embodiment, the vehicle system 140 is depicted as a locomotive, however, the vehicle system 140 may be configured otherwise in other embodiments, for example as a rail vehicle consist, or, as another example, as a non-rail vehicle. In some embodiments, the vehicle system 140 may include an internal source, such as a diesel powered generating unit and/or battery, for providing motive force. In some embodiments, the vehicle system 140 may receive energy for providing motive force from an external power source disposed along the route 102, such as a third rail or overhead catenary. The vehicle system 140 depicted in FIG. 1 includes a processing unit 142, an antenna 150, and a time reference module 152.

The processing unit 142 is configured to be disposed onboard the vehicle system 140, and includes a memory 143, a timing determination module 144, and a communication module 146. It should be noted that FIG. 1 is intended by way of example and is schematic in nature. In various embodiments, various modules (or portions thereof) of the processing unit 142 may be added, omitted, arranged differently, or joined into a common module, various portions of a module or modules may be separated into other modules or submodules and/or be shared with other modules, or the like The timing determination module 144 is configured to determine, based on a speed of the vehicle system 140, timing information corresponding to a time at which the vehicle system 140 will travel proximate the crossing 170. For example, the vehicle system 140 may determine a distance to the crossing 170 based on information received from the remote crossing module 120 and/or information stored in the memory 143 (e.g., in a database stored in the memory 143). For example, the timing determination module may compare a location as determined by a GPS detector (e.g., time reference module 152) with information regarding the location of the crossing 170 stored in a database of the memory 143 and/or provided via communication with the remote crossing module 120. Information regarding the speed of the vehicle system 170 in some embodiments may be obtained from a sensor or detector associated with the vehicle system 140, such as a speedometer, tachometer, or the like. In some embodiments, a current speed of the vehicle system 170 obtained from a sensor or detector may be used to estimate an arrival time at the crossing 170 based on the distance to the crossing 170.

Additionally or alternatively, information regarding future speed may also be used to determine a projected arrival time at the crossing. For example, information regarding a current speed and/or future speed along the route 102 may be obtained from a predetermined trip plan and used to calculate a projected time of arrival. Thus, if the vehicle system 140 will be speeding up and/or slowing down between the time of determination of arrival time and the actual arrival time, such changes in speed called for by a trip plan may be used by the timing determination module 144 to determine an estimated time of arrival at the crossing 170. Further, in various embodiments, the arrival time is computed or determined as an absolute time (e.g., a time specified with reference to a high precision synchronization scheme). For example, timing information may be determined using a current time provided by a time reference module 152, with the time provided as an absolute time, with a similarly configured clock available to or associated with the remote crossing module 120. In various embodiments, the time reference module 152 may provide a time reference, and in other embodiments the time reference module 152 may also process time. Further, in various embodiments, a time reference module may be incorporated into one or more other modules of the transportation system 100. For example, the processing unit 122 of the remote crossing module 120 may have a time reference module incorporated therein, and the processing unit 142 of the vehicle system 140 may have a time reference module incorporated therein. The processing unit 122 and the processing unit 142 may receive timing information via similar interfaces (e.g., GPS, NTP). In some embodiments, the time reference module 152 may be configured as or include a clock synchronized to a common timing scheme. In some embodiments, the time reference module 152 may be a GPS detection unit that provides an absolute time based on a GPS time to the timing determination module 144. The timing determination module 144 may then determine an arrival time by adding the projected time remaining until the vehicle system 140 reaches the crossing to a current time provided by the time reference module 152. In the illustrated embodiment, the timing determination module 144 provides timing information corresponding to an arrival time of the vehicle 140 at the crossing 170 to the communication module 146 for transmission via the antenna 150 to the remote crossing module 120.

The communication module 146 is configured to communicatively couple the determination module to the remote crossing module. For example, the communication module 146 may receive timing information from the timing determination module 144, compile and/or format the timing information into a message 154, and transmit the message 154 (via the antenna 150) to the communication module 124 of the remote crossing module 120 (via the antenna 129). The communication module 146 may be configured to one or more of receive messages (e.g., messages from the remote crossing module 120), transmit messages, pre-process information or data received in a message, format information or data to form a message, decode a message, decrypt or encrypt a message, compile information to form a message, extract information from a message, or the like. For example, the communication module 146 may be configured to use information from the timing determination module 144 to construct the message 154. In various embodiments, one or more of timing information, track identification information, or suppression information may be formatted into a message along with other message portions, such as a header, address, additional information, or the like. Suppression information, identification information, and timing information may be sent together as one message, or, as another example, may be sent as parts of separate messages.

The timing information provided via the message 154 may be configured as an absolute time. As one example, in various embodiments, the reference time may be a time to initiate a crossing warning activity, such as one or more of closing a gate, activating warning lights, sounding an alarm, or the like. The communication module 146 (and/or timing determination module) may determine the reference warning time by offsetting a projected arrival time by a desired warning time. If 20 seconds of warning are desired to be provided before the vehicle system 140 arrives at the crossing 170, the reference warning time communicated by the communication module 146 may be determined as occurring twenty seconds prior to the estimated, projected, or otherwise determined arrival time. The reference warning time may be configured as an absolute time. As another example, in some embodiments, the reference time may be a projected or estimated time of arrival (configured as an absolute time) of the vehicle system 140 at the crossing 170. The remote crossing module 120 may use such a reference time of arrival to determine a crossing activation time based on a desired warning time to be provided to vehicles and/or personnel (e.g., motorists) along the second route 160 proximate the crossing 170.

In various embodiments, the communication module 146 may communicate suppression information to the remote crossing module 120, with the suppression information configured to suppress, prevent, or inhibit the activation of the warning crossing system 110 otherwise called for by the automatic closure module 128 and/or track detection system 130. In one example scenario, the vehicle system 140 may be traveling faster than a reference speed corresponding to the capability of the track detection system 130 and/or the automatic closure module 128. In such a scenario, the automatic closure module 128 and track detection system 130 are not capable of activating the crossing warning system 110 in time to provide a sufficient or desired warning time. Accordingly, timing information from the communication module 146 may be transmitted to the remote crossing module 120 before the vehicle system 140 enters the range 104 of the track detection system 130 so that the warning crossing system 110 may be activated sufficiently before the vehicle system 140 enters the crossing 170. Because the timing information is sent as an absolute time, additional time to account for messaging delays need not be added, and a consistent warning and/or closure period may be provided.

In another example scenario, the vehicle system 140 is traveling at or about the reference speed corresponding to the capability of the track detection system 130. In such a scenario, if the timing determination module 144 determines that the speed of the vehicle system 140 is a speed that may be handled conveniently by the automatic closure module 128, the vehicle system 140 may be configured to forego sending timing information and rely instead on the automatic closure module 128 to operate the crossing warning system 110. Alternatively, the vehicle system 140 may send the timing information, and the automatic closure module 128 and/or track detection system 130 may be utilized as a back-up or for redundancy in case of any difficulties in the transmission, reception, or comprehension of the timing information. Still further alternatively, in such a scenario, the communication module 146 may provide timing information as well as suppression information to the remote crossing module. For example, if the vehicle system 140 slows down after entering the range 104, and after the automatic closure module 128 determines a projected arrival time of the vehicle system 140 at the crossing 170, the automatic closure module 128 may activate a warning (e.g., close a gate) earlier than desired. Thus, if the timing determination module 144 determines (e.g., based on information received from a trip plan) that the vehicle system 140 will be slowing substantially after entering the range 104 of the track detection system 130, suppression information configured to suppress the activation otherwise called for by the automatic closure module 128 may be provided to the remote crossing module 120 before the vehicle system 140 enters the range 104.

In yet another example scenario, the vehicle system 140 is traveling at a relatively slow speed, slower than the reference speed corresponding to the capability of the track detection system 130. Thus, for example, if the track detection system 130 is an occupancy detection system, the automatic closure module 128 may initiate a warning activity upon entry of the vehicle system 140 into the range 104, resulting in an overly long closure or warning time. To help prevent the overly long closure or warning time, in various embodiments the communication module 146 of the vehicle system 140 may transmit a message or messages (e.g., message 154) to the remote crossing module include both timing information corresponding to an activation time of the crossing warning system 110 based on the projected arrival time of the vehicle system 140 at the crossing 170, as well as suppression information configured to suppress, impede, prevent, or inhibit operation of the crossing warning system 110 otherwise called for by the automatic closure module 128 and the track detection system 130. Such information may be sent before the vehicle system 140 enters the range 104 to help prevent premature activation of the crossing warning system 110 as well as to help prevent gate pump (e.g., lowering and raising of a gate caused by conflicting or inconsistent activations called for by the timing determination module 126 and the automatic closure module 128).

Further still, in various embodiments, the communication module 146 may be configured to transmit track or sub-route identification information to the remote crossing module. For example, in some areas, a transportation network may include multiple adjacent sub-routes or separate tracks, such that vehicle systems may travel generally parallel to each other. Thus, multiple adjacent sub-routes of a route 102 may each cross a second route (e.g., second route 160) at the same crossing 170. In such embodiments, a given remote crossing module 120 and/or crossing warning system 110 may be configured to provide a warning based on traffic along multiple sub-routes. Track identification information may be utilized by such a remote crossing module 120 to ensure that automatic closure activities are only suppressed for a particular track upon which a vehicle sending suppression information is disposed. (See also FIG. 2 and related discussion.)

For instance, in one example scenario, the route 102 may comprise plural sub-routes (e.g., tracks running parallel to each other through the crossing 170, with each sub-route configured to accommodate travel by a vehicle when the other sub-routes are occupied with other vehicles). The suppression information may include sub-route identification information corresponding to particular sub-route on which the vehicle system 140 is traveling. For instance, the route 102 may include tracks A, B, and C, with B identified as the sub-route or track upon which the vehicle system 140 is traveling. The identification information may be determined based on information provided at the outset of the mission and/or periodically updated as the vehicle system 140 performs a mission. With the suppression information identified as corresponding to track B, if the automatic closure module 128 detects a vehicle on either of tracks A or C instead of track B, the automatic closure module 128 may operate the crossing warning system 110 to activate a warning (for example, the remote crossing module 120 may override the suppression information associated with a different track, or, as another example, the remote crossing module 120 may ignore the suppression information associated with a different track). In various embodiments, the remote crossing module may receive timing information and/or detect the presence of vehicles along multiple sub-routes or tracks, and be configured to select the most restrictive warning activity (e.g., the earliest occurring warning activity) from among plural warning initiations called for by the various messages or detected activity.

Thus, as discussed herein, various embodiments provide for more consistent warning times at crossings, and/or reduce delay, inconvenience and/or confusion caused by overly long warning periods. Various embodiments provide for improved consistency of warning time in electrified territory where crossing predictors may not be used. Further, various embodiments provide for improved consistency of warning time at relatively slow vehicle speeds, and/or when vehicle speeds are anticipated to change proximate to a crossing.

Figure 2:
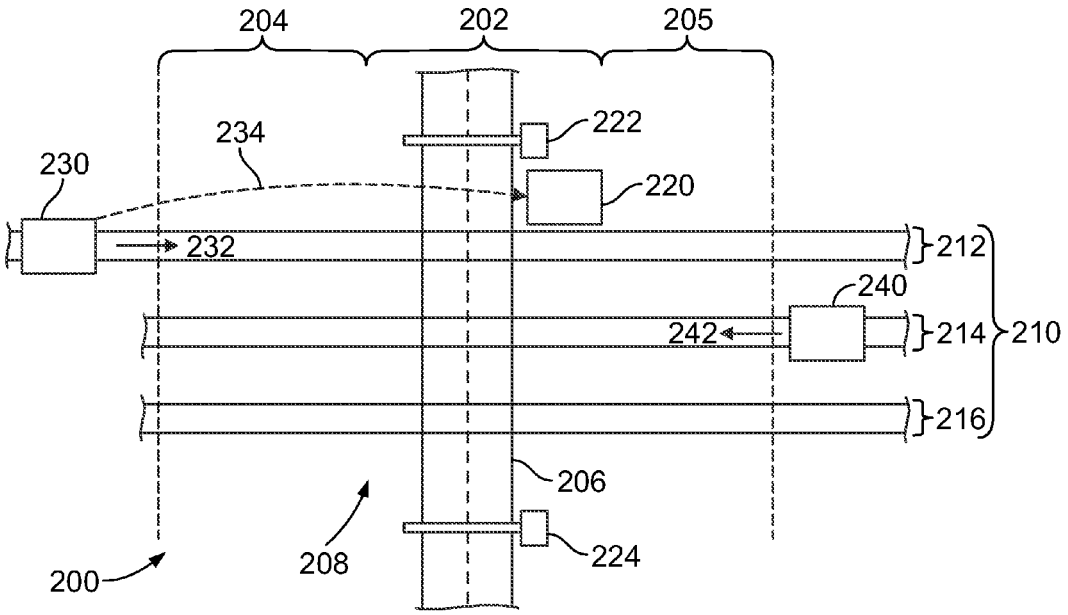
FIG. 2 is an overhead schematic diagram of a transportation network in accordance with one embodiment.

FIG. 2 provides an overhead schematic diagram of one embodiment of a transportation network 200 formed in accordance with one embodiment. The transportation network 200 is configured to utilize timing information including suppression information and track identification information to provide constant warning times utilizing messages from vehicles approaching a crossing, as well as to utilize automatic initiation of a warning based on information from a track detection system or circuit when appropriate. The transportation network 200 includes a first route 210 that includes generally parallel sub-routes 212, 214, 216. In the illustrated embodiment, each sub-route may be configured as a pair of tracks or rails configured for travel by a rail vehicle. In FIG. 2, a first rail vehicle 230 traverses the track 212 in a direction 232, and a second rail vehicle 240 traverses the track in a direction 242. The rail vehicles 230, 240 may each be configured as, for example, a rail vehicle consist or another vehicle capable of self-propulsion. In various embodiments, the rail vehicles 230, 240 may receive power from a power source (not shown) disposed along the first route 210, such as a third rail or overhead catenary. Each of the depicted sub-routes or tracks 212, 214, 216 intersect a second route 206 at a crossing 208. The transportation network 200 also includes crossing gates 222, 224 positioned on either side of the first route 210 along the second route 206. The crossing gates 222, 224 are configured to impede traffic along the second route 206 through the crossing 208 when activated. The transportation network 200 further includes a remote crossing module 220 configured to operate the crossing gate 222 and the crossing gate 224.

The network 200 also includes an island 202 interposed between approaches 204, 205. The island 202 corresponds to an area for which the crossing gates 222, 224 are configured to be closed whenever a vehicle is present along the first route 102, regardless of whether the vehicle is moving or not. The approaches 204, 205 define areas within the range of a track detection system utilized by the remote crossing module 220.

The remote crossing module 220 may determine when to activate (or de-activate) a warning crossing in certain respects generally similar to the discussion herein regarding the embodiment depicted in FIG. 1. For example, the remote crossing module 220 may operate the crossing gates 222, 224 responsive to information received from a vehicle (e.g., rail vehicle 230) and/or responsive to information received from a track detection system (e.g., track detection system 130 discussed in conjunction with FIG. 1).

An example scenario illustrating the use of suppression and track identification information will now be discussed in connection with FIG. 2. In the example scenario, the rail vehicle 230 is traveling toward the crossing 208 along the track 212 of the first route 102. The rail vehicle 230 is outside of the approach 204 and therefore beyond the range of the automatic closure module of the remote crossing module 220. The rail vehicle 240 is traveling toward the crossing 208 along the track 214 of the first route 102. The rail vehicle 240 is outside of the approach 205 and also beyond the range of the automatic closure module of the remote crossing module 220. In the example scenario, the rail vehicle 240 is traveling at a higher rate of speed than the rail vehicle 230. The rail vehicle 230 is traveling at a speed lower than a reference speed corresponding to the ability of the remote crossing module 220 to activate the crossing gates 222, 224 using information from a track detection system, while the rail vehicle 240 is traveling at or about at the reference speed.

The rail vehicle 230 is configured to send timing information to the remote crossing module 220 in the example scenario; however, the rail vehicle 240 is not (e.g., an antenna and/or communication module of the rail vehicle 240 may be damaged, the rail vehicle 240 may be an older model, or the like). In the illustrated embodiment, the rail vehicle 230 sends a message 234 to the remote crossing module. The message 234 includes timing information corresponding to a time when the rail vehicle 230 will enter the crossing 208. The remote crossing module 220 is configured to determine a time to activate (e.g., lower) the crossing gates 222, 224 based on the timing information. Further, as the rail vehicle 230 is traveling slower than the reference speed, the message 234 includes suppression information to prevent an otherwise automatic activation of the crossing gates 222, 224 when the rail vehicle 230 enters the approach 204.

Further still, the message 234 includes track identification information identifying track 212 as the sub-route upon which the rail vehicle 230 is traveling. For example, the track identification information may be obtained by the rail vehicle 230 using one or more of manually input information, information from switches the rail vehicle 230 has passed over, location determination systems utilizing GPS, RFID tags, or the like. The rail vehicle 230 may also utilize an onboard database describing or depicting the layout of the transportation network 200 or portions thereof. The remote crossing module 220 is configured to use the track identification information to suppress automatic activation of the crossing gates 222, 224 only for track 212, and not for other tracks or sub-routes. Thus, if a different vehicle approaches on a different track, the crossing gates 222, 224 may be activated as appropriate based on the other vehicle's position.

For example, in the illustrated embodiment, as the rail vehicle 240 enters the approach 205, the remote crossing module 220 is configured to identify the rail vehicle as traveling on a different track (e.g., track 214) than the track 212 for which suppression information corresponding to the rail vehicle 230 has been received. Thus, the remote crossing module 220 may over-ride or ignore the suppression information to activate the crossing gates 222, 224, avoiding a dangerous situation where the rail vehicle 240 may have passed through the crossing 208 without the crossing gates 222, 224 being activated.

Figure 3:
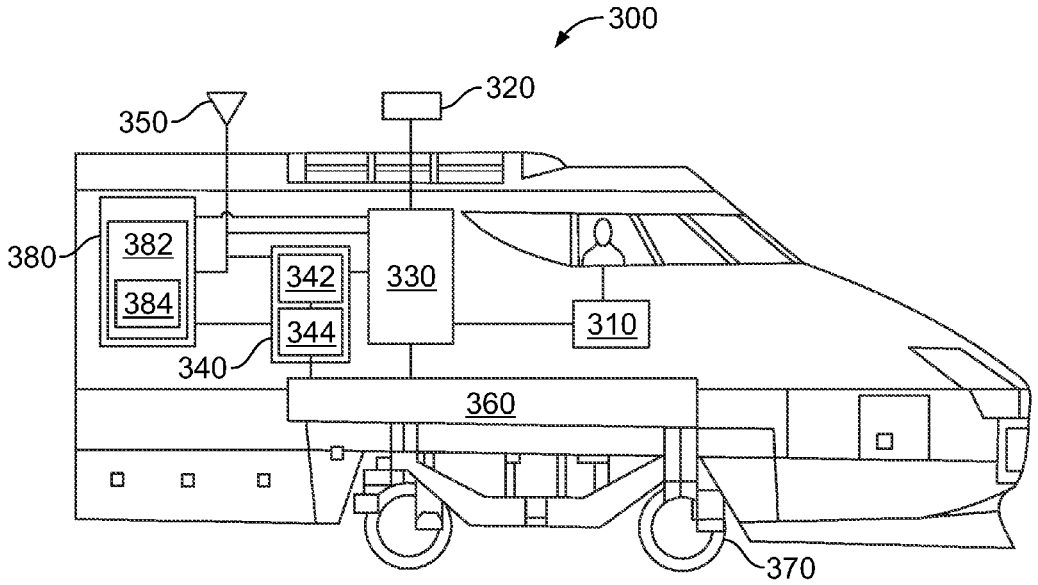
FIG. 3 is a schematic view of a vehicle system in accordance with one embodiment.

FIG. 3 provides a schematic view of a vehicle system 300 formed in accordance with an embodiment. The vehicle system 300 may include, for example, a rail vehicle consist including rail vehicle units (e.g., locomotives and non-powered units). The vehicle system 300 of the illustrated embodiment includes a manual input module 310, an automatic input module 320, an automatic control module 330, a trip planning control module 340, an antenna 350, a propulsion system 360, wheels 370, and a timing determination module 380. Generally speaking, in the depicted embodiment, the trip planning control module 340 is configured to plan a trip and to provide control messages, either to an operator and/or directly to the propulsion system 360, to propel the vehicle system 300 along a trip or mission. The propulsion system 360 may include one or more motors and one or more brakes, with the control messages configured to cause the propulsion system to engage in braking or motoring activities in accordance with a trip plan. The automatic control system 330 may be configured to operate in accordance with a PTC system. In the illustrated embodiment, the automatic control system 330 is configured to override the trip planning control module 340 and/or an operator control, for example, to stop or slow the vehicle system 300 in accordance with a rule, for example a speed limit, or a safety condition such as a lockout or circumstance where another vehicle occupies a segment of a route the vehicle system 300 would otherwise enter pursuant to a command by the trip planning control module 340 and/or operator control. The antenna 350 is configured for communication between the vehicle system 300 and one or more off-board systems, such as, for example, wayside stations (e.g., remote crossing module 120, 220) and/or central scheduling systems and/or other vehicles traversing a transportation network. The rail vehicle system 300 is depicted as a single powered rail vehicle unit for ease of depiction. Other vehicle systems, including rail vehicle consists, may be employed in other embodiments.

The manual input module 310 is configured to obtain manually input information including manually input location information. The manually input location information may be used alone or in conjunction with automatically input location information by the timing determination module 380 to determine track identification information for the rail vehicle system 300. The manually input information may correspond to information obtained via operator observation from one or more sources. For example, the manually input information may be obtained from a sign or other object configured to convey position information and mounted, hung, or otherwise disposed proximate to a track or route.

The automatic input module 320 is configured to automatically obtain (e.g., without operator intervention) location information and/or timing information. The automatically obtained information may correspond to a particular route or track (e.g., automatically obtained information may describe a change in particular track being traversed due to the activation of a switch); a location along a track or route (e.g., information from a GPS detector giving a geographic position or identifying a segment of a track or route where the vehicle system 300 is located); and/or a direction (e.g. information from a GPS detector taken at different times with the vehicle system 300 in motion used to determine a trend or direction). The automatic input module 320 in the illustrated embodiment is also configured to provide absolute time information to be utilized by the timing determination module 380. For example, the automatic input module may include timing information from a GPS system or other system synchronized to a common time reference as one or more remote crossing modules. Automatically obtained information may also include speed information used by the timing determination module to determine a projected time of arrival at a crossing. Thus, the vehicle system 300 may include one or more of a GPS detector, an axle tachometer, inertial system, LORAN system, or the like. Further, the automatic input module may include a receiver configured to receive location information from a transponder associated with a track or route on which the vehicle system 300 is disposed, for example a transponder associated with a wayside station, a switch, and/or a signal. For example, a message associated with a switch may provide information regarding a change from one track or route to another due to a position of the switch, or a message from a wayside station may include information corresponding to a vehicle's position along a route or track based on the location of the wayside station.

In the illustrated embodiment, the automatic control module 330 is configured to control the vehicle system 300 to conform to a set of regulations along a route during a trip or mission performed by the vehicle system 300. The automatic control module 330 may be configured to control the vehicle system 300 pursuant to a PTC system. The regulations may be location-based regulations. The regulations may be based on a rule or requirement of operation for a particular route segment, such as a speed limit or the like. The regulations may also correspond to a condition of a track or related componentry, such as if a route segment is occupied by a different vehicle, if a switch is misaligned, or the like. The automatic control module 330 may use location information provided by the manual input module 310 and the automatic input module 320 to determine appropriate automatic control activities. The automatic control module 330, when enabled, may override or interrupt a previously planned controlled activity (e.g., a control activity previously determined by the trip planning control module 340) and/or an operator controlled activity.

The trip planning control module 340 of the vehicle system 300 may be configured to receive a schedule sent by an off-board scheduling system. The trip planning control module 340 may include a controller, such as a computer processor or other logic-based device that performs operations based on one or more sets of instructions (e.g., software). The instructions on which the controller operates may be stored on a tangible and non-transitory (e.g., not a transient signal) computer readable storage medium, such as a memory 344. The memory 344 may include one or more computer hard drives, flash drives, RAM, ROM, EEPROM, and the like. Alternatively, one or more of the sets of instructions that direct operations of the controller may be hard-wired into the logic of the controller, such as by being hard-wired logic formed in the hardware of the controller.

The trip planning control module 340 may include one or more modules that perform various operations. The control module 342, along with other modules (not shown) may be included in the controller. The modules may include hardware and/or software systems that operate to perform one or more functions, such as the controller and one or more sets of instructions. Alternatively, one or more of the modules may include a controller that is separate from the controller, or may be combined to form a combined module.

The trip planning control module 340 may receive a schedule from a scheduling system. The trip planning control module 340 may be operatively coupled with, for example, the antenna 350 to receive an initial and/or modified schedule from the scheduling system. In one embodiment, the schedules are conveyed to the control module 342 of the trip planning control module 340. In another embodiment, the control module 342 may be disposed off-board the vehicle system 300 for which the trip plan is formed. For example, the control module 342 may be disposed in a central dispatch or other office that generates the trip plans for one or more vehicles.

In the illustrated embodiment, the control module 342 receives the schedule sent from the scheduling system and generates a trip plan based on the schedule. The trip plan may include throttle settings, brake settings, designated speeds, or the like, of the vehicle system 300 for various sections of a scheduled trip or mission of the vehicle system 300 to the scheduled destination location. The trip plan may be generated to reduce the amount of fuel that is consumed by the vehicle system 300 as the vehicle system 300 travels to the destination location relative to travel by the vehicle system 300 to the destination location when not abiding by the trip plan.

In order to generate the trip plan for the vehicle system 300, the control module 342 can refer to a trip profile that includes information related to the vehicle system 300, information related to a route over which the vehicle system 300 travels to arrive at the scheduled destination, and/or other information related to travel of the vehicle system 300 to the scheduled destination location at the scheduled arrival time. The information related to the vehicle system 300 may include information regarding the fuel efficiency of the vehicle system 300 (e.g., how much fuel is consumed by the vehicle system 300 to traverse different sections of a route), the tractive power (e.g., horsepower) of the vehicle system 300, the weight or mass of the vehicle system 300 and/or cargo, the length and/or other size of the vehicle system 300, the location of powered units in the vehicle system 300, or other information. The information related to the route to be traversed by the vehicle system 300 can include the shape (e.g., curvature), incline, decline, and the like, of various sections of the route, the existence and/or location of known slow orders or damaged sections of the route, and the like. Other information can include information that impacts the fuel efficiency of the vehicle system 300, such as atmospheric pressure, temperature, and the like.

The trip plan is formulated by the control module 342 based on the trip profile. For example, if the trip profile requires the vehicle system 300 to traverse a steep incline and the trip profile indicates that the vehicle system 300 is carrying significantly heavy cargo, then the control module 342 may form a trip plan that includes or dictates increased tractive efforts for that segment of the trip to be provided by the propulsion subsystem 360 of the vehicle system 300. Conversely, if the vehicle system 300 is carrying a smaller cargo load and/or is to travel down a decline in the route based on the trip profile, then the control module 342 may form a trip plan that includes or dictates decreased tractive efforts by the propulsion subsystem 350 for that segment of the trip. In one embodiment, the control module 342 includes a software application or system such as the Trip Optimizer™ system provided by General Electric Company. The control module 342 may directly control the propulsion system 360 and/or may provide prompts to an operator for control of the propulsion system 360. As discussed above, control activities planned by the trip planning control module 340 may be overridden by control activities called for by the automatic control module 330.

The timing determination module 380 may include a memory 382 including a database 384. The timing determination module 380 is configured to determine an estimated or projected time of arrival of the rail vehicle system 300 at an upcoming crossing and to communicate timing information corresponding to the arrival at the crossing to a remote crossing module associated with the crossing. For example, the timing determination module 380 may determine a distance to a crossing. The timing determination module 380 may obtain location information describing or corresponding to a position along a route of the rail vehicle system 300 from the automatic input module 320. The timing determination module 380 may then determine a distance from the rail vehicle system 300 to a given crossing using, as one example, information from a remote crossing module describing or corresponding to the location of the crossing received via antenna 350, or as another example, information from the database 384 describing or corresponding to the location of the crossing.

The timing determination module 380 may further obtain speed information corresponding to the current and/or future speed of the vehicle system 300. For example, a current speed may be obtained from the automatic input module 320 (e.g., axle tachometer, change in GPS position, speedometer, or the like). The current speed, along with the distance to the crossing, may be used to determine an estimated or projected time of arrival. Additionally or alternatively, a current and/or future speed (or speeds) may be obtained from the trip planning control module 340. Trip plan information describing or corresponding to the upcoming speed of the rail vehicle system 300 before the rail vehicle system 300 arrives at the crossing may be used to determine arrival time (e.g., if speed is going to change between determination time and arrival time). For example, if the rail vehicle system 300 is going to slow down between the time of determining an arrival time and arrival, the arrival time may be determined to occur an appropriate amount of time later than if determined using the current speed. As another example, if the rail vehicle system 300 is going to speed up between the time of determining an arrival time and arrival, the arrival time may be determined to occur an appropriate amount of time earlier than if determined using the current speed. If the speed deviates from the speed called for by the trip plan after the timing information is transmitted to a remote crossing module, the arrival time may be re-determined and a subsequent message sent to the remote crossing module.

Figure 4:
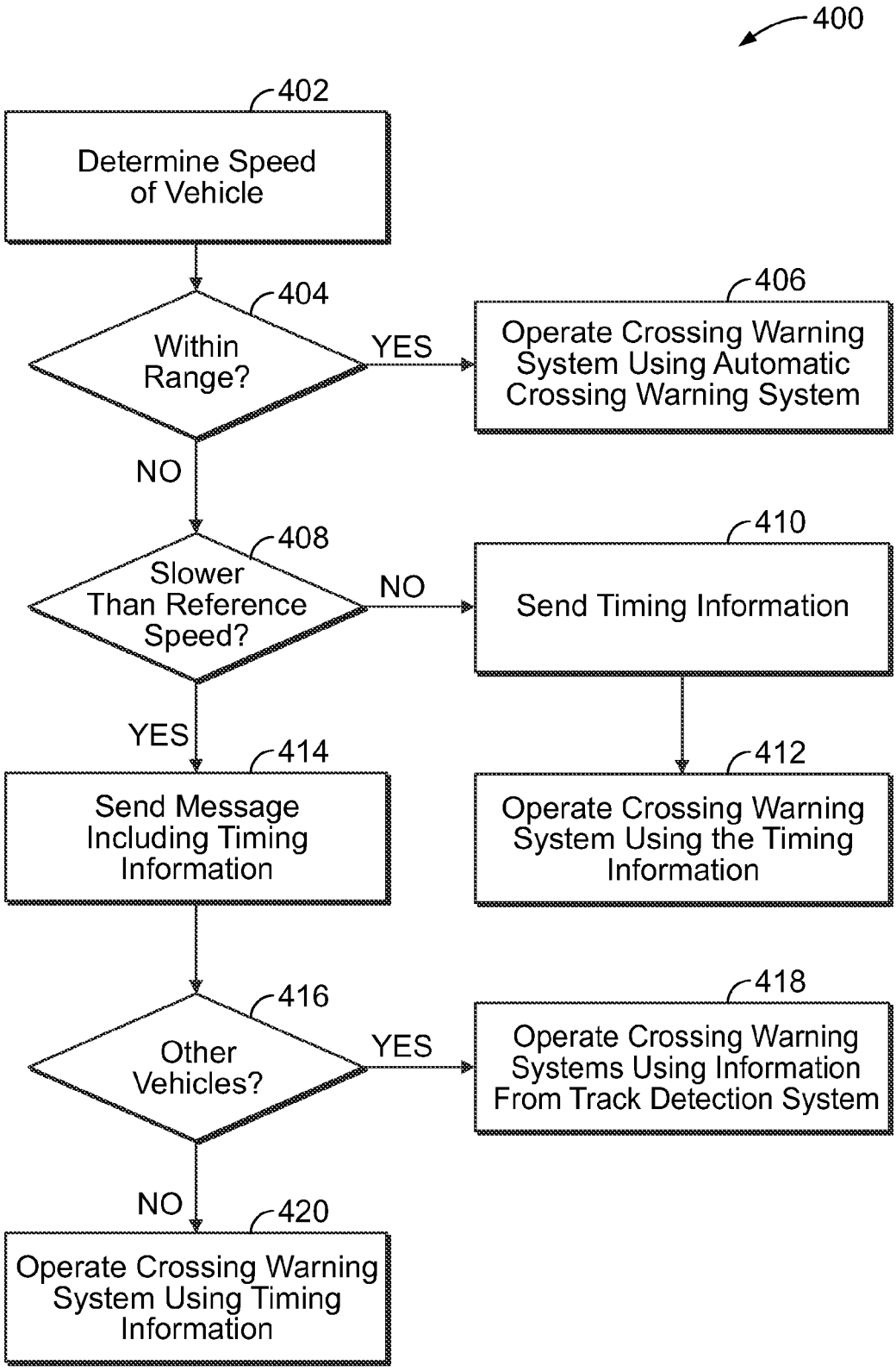
FIG. 4 is a flowchart of one embodiment for operating a crossing.

FIG. 4 is a flowchart of one embodiment of a method 400 for determining a warning time (e.g., closing time) for a crossing. The method 400 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 402, the speed of a vehicle (e.g., a rail vehicle) traversing a first route is determined as the vehicle approaches a crossing. The speed may be determined onboard a vehicle traversing a route (e.g., timing determination module 144). In various embodiments the speed may be determined based on a measured speed and/or a speed called for by a trip plan or other control scheme.

At 404, it is determined if the speed of the vehicle lies within a predetermined range of a reference speed of an automatic crossing warning system. The automatic crossing warning system may include a track detection system (e.g., track detection system 130) and/or an automatic detection module (e.g., automatic closure module 128). In some embodiments, the determination of whether or not the speed lies within the predetermined range of the reference speed of the automatic crossing system may be made onboard a vehicle (e.g., at the timing determination module 144). The reference speed may be understood as the speed at which a vehicle can be traveling for which the automatic closure module can detect the vehicle and close the crossing in time to meet a standard time for closing before arrival of the vehicle at the crossing. The automatic crossing warning system may be configured to impede travel (e.g., by closing gates, activating lights, sounding alarms, or the like) along a second route that intersects the first route at the crossing. If the speed of the vehicle is within the predetermined range of the reference speed automatic crossing warning system, the method proceeds to step 406, but if the speed of the vehicle is outside of the predetermined range (e.g., more than a specified amount below the reference speed or more than a specified amount above the reference speed), the method proceeds to step 408.

At 406, the automatic crossing warning system is utilized to operate a crossing warning system (e.g., lowering a gate). In some embodiments, the crossing warning system may be operated according to information obtained from a crossing predictor system as discussed herein. It should be noted than in alternate embodiments, steps 404 and 406 may be omitted and timing information may be transmitted from the vehicle regardless of vehicle speed. In various embodiments, an automatic crossing warning system may be used as back-up for timing information sent by an approaching vehicle, and/or may be used with older vehicles not configured to transmit timing information as discussed herein.

At 408, it is determined if the current (or expected) speed of the vehicle is slower than the reference speed. If the speed is not slower than the reference speed (e.g., the speed is higher than the reference speed), the method proceeds to step 410. If the speed is lower than the reference speed, the method proceeds to 414.

At 410, timing information is sent from the vehicle (e.g., from the communication module 146 via antenna 150) to a remote crossing module. The timing information is transmitted before the vehicle enters a range of a track detection system associated with the crossing, and includes a reference time configured as an absolute time. In some embodiments, the reference time may be an estimated time of arrival of the vehicle at the crossing. In some embodiments, the reference time may be a time to activate a crossing warning system.

At 412, a crossing warning is activated (e.g., a gate lowered or the like) using the timing information. For example, a warning determination module disposed onboard a remote crossing module may determine an activation time using a reference time included in the timing information, and operate the crossing warning in accordance with the determined activation time. For example, if the reference time is a time of arrival, the warning determination module may determine an activation time a predetermined amount of time before the arrival time, and activate the crossing warning at the activation time.

At 414, with the speed slower than the reference speed, a message including timing information is transmitted from the vehicle to a remote crossing module. The message or timing information may also include suppression information and track identification information. The remote crossing module is configured to prevent an otherwise called for activation of a crossing warning called for by information received from a track detection system responsive to the suppression information. The track identification information identifies a track upon which the vehicle is traveling, and is used by the remote crossing module to over-ride or ignore the suppression information when a different vehicle is detected on a different track.

At 416, it is determined if one or more other vehicles are approaching the crossing on a different track than the track on which the vehicle that sent the timing information is approaching. For example, a track detection system may be employed to determine if any other vehicles are approaching on any other tracks. If other vehicles are detected, the method proceeds to step 418. If no other vehicles are detected, the method proceeds to step 420. Additionally, in various embodiments, if it is determined (e.g., by the onboard processing unit 142) that the route up to the crossing is not clear (for example, if the vehicle is following another vehicle or vehicles that may not be equipped with PTC) suppression information may not be sent to the remote crossing module.

At 418, a crossing warning is activated based on information received from the track detection system indicating the presence or approach of a vehicle not associated with previously transmitted suppression information. At 420, suppression is continued as the vehicle which transmitted the suppression information enters the range of the track detections system. The crossing warning is instead activated (e.g., a gate lowered or the like) using the timing information transmitted from the vehicle. For example, a warning determination module disposed onboard a remote crossing module may determine an activation time using a reference time included in the timing information, and operate the crossing warning in accordance with the determined activation time. For example, if the reference time is a time of arrival, the warning determination module may determine an activation time a predetermined amount of time before the arrival time, and activate the crossing warning at the activation time.

In one embodiment, a system includes a determination module and a communication module. The determination module is configured to be located onboard a first vehicle configured to travel along a first route. The first route includes a crossing corresponding to an intersection of the first route with a second route. The determination module is configured to be communicatively coupled with a remote crossing module that is configured to impede travel of a second vehicle along the second route through the crossing when the first vehicle is proximate the crossing. The determination module is configured to determine, based on a speed of the first vehicle, timing information corresponding to a time at which the first vehicle will travel proximate the crossing. The communication module is configured to communicatively couple the determination module to the remote crossing module, and to transmit the timing information to the remote crossing module. The timing information includes a reference time corresponding to a time for impeding travel of the second vehicle along the second route through the crossing, and is configured as an absolute time.

In another aspect, the system may be configured to transmit the timing information before the first vehicle enters a range of an automatic closure module associated with the remote crossing module when the first vehicle is traveling at a speed that is slower than a reference speed. The reference speed corresponds to a speed for which the automatic closure module is configured to impede travel of the second vehicle along the second route through the crossing.

In another aspect, the communication module may be configured to transmit a suppression message to the remote crossing module. The suppression message is configured to prevent operation of the automatic closure module when the first vehicle travels slower than the reference speed. Further, in various embodiments, the first route may include plural sub-routes, and the suppression information may include sub-route identification information corresponding to a particular sub-route on which the first vehicle is traveling.

In another aspect, the first vehicle may be configured as an electric powered vehicle configured to receive energy from at least one of a rail or overhead power source.

In another aspect, the reference time may be a time at which the first vehicle will enter the crossing.

In another aspect, the reference time may be a time at which a gate corresponding to the crossing is to be closed.

In another embodiment, a system includes a remote crossing module configured to be disposed along a first route along which a first vehicle is configured to travel. The first route includes a track and a crossing corresponding to an intersection of the first route with a second route. The remote crossing module is configured to impede travel of a second vehicle along the second route through the crossing when the first vehicle is proximate the crossing on the first route. The remote crossing module includes a communication module, a determination module, and an automatic closure module. The communication module is configured to communicatively couple the remote crossing module to the first vehicle and to receive timing information from the first vehicle. The timing information includes a reference time corresponding to a time for impeding travel of the second vehicle along the second route through the crossing, with the reference time configured as an absolute time. The determination module is configured to determine a closing time to impede travel along the second route using the timing information. The automatic closure module is configured to impede travel along the second route using information obtained from a track detection system configured to detect signals sent via the track.

In another aspect, the remote crossing module may be configured to receive the timing information before the first vehicle enters a range of the automatic closure module when the first vehicle is traveling at a speed that is slower than a reference speed. The reference speed corresponds to a speed for which the automatic closure module is configured to impede travel of the second vehicle along the second route through the crossing. The timing information may include a suppression message, wherein the remote crossing module is configured to suppress operation of the automatic closure module responsive to receiving the suppression message. Further, in various embodiments, the first route may include plural sub-routes, and the suppression information may include sub-route identification information corresponding to a particular sub-route on which the first vehicle is traveling. The remote crossing module may be configured to override the suppression message when the automatic crossing module receives information corresponding to a closing condition from a portion of the route other than the particular sub-route on which the first vehicle is traveling.

In another aspect, the automatic closure module may be configured to receive information from a crossing predictor detection system comprising a shunt positioned along the first route. The automatic closure module may be configured to impede travel of the second vehicle along the second route through the crossing based on a speed and location of the first vehicle determined using the information from the crossing predictor detection system.

In another aspect, the automatic closure module may be configured to receive information from a track occupancy detection system. The automatic closure module may be configured to impede travel of the second vehicle along the second route through the crossing based on a track occupancy.

In another aspect, the closing time may be configured as an absolute time.

Another embodiment relates to a method that includes determining, at a processing unit disposed onboard a first vehicle configured to travel along a first route, timing information corresponding to a time at which the first vehicle will travel proximate a crossing based on a speed of the first vehicle. The crossing corresponds to an intersection of the first route with a second route. The method also includes communicating the timing information to a remote crossing module disposed along the first route proximate the crossing. The remote crossing module is configured to impede travel of a second vehicle along the second route through the crossing when the first vehicle is proximate the crossing on the first route. The timing information includes a reference time configured as an absolute time corresponding to a time for impeding travel of the second vehicle along the second route through the crossing.

In another embodiment of the method, the timing information is communicated to the remote crossing module before the first vehicle enters a range of an automatic closure module associated with the remote crossing module when the first vehicle is traveling at a speed that is slower than a reference speed. The reference speed corresponds to a speed for which the automatic closure module is configured to impede travel by the second vehicle along the second route through the crossing. In various embodiments, the method may also include communicating a suppression message to the remote crossing module. The suppression message is configured to prevent operation of the automatic closure module. Further still, in various embodiments, the first route may include plural sub-routes, and the suppression information may include sub-route identification information corresponding to a particular sub-route on which the first vehicle is traveling, with the method further including overriding the suppression message when a different vehicle approaches the crossing on a portion of the first route other than the particular sub-route on which the first vehicle is traveling.

In another embodiment of the method, the first vehicle may be configured as an electric powered vehicle configured to receive energy from at least one of a rail or overhead power source.

In another embodiment of the method, the reference time is a time at which the first vehicle will enter the crossing.

In another embodiment of the method, the reference time is a time at which a gate corresponding to the crossing is to be closed.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system comprising:

a determination module configured to be located onboard a first vehicle configured to travel along a first route, the first route including a crossing corresponding to an intersection of the first route with a second route, the determination module configured to be communicatively coupled with a remote crossing module configured to impede travel of a second vehicle along the second route through the crossing when the first vehicle is proximate to the crossing on the first route, wherein the determination module is configured to determine, based on a speed and location of the first vehicle, timing information corresponding to a time at which the first vehicle will travel proximate to the crossing; and a communication module configured to communicatively couple the determination module to the remote crossing module, the communication module configured to transmit the timing information to the remote crossing module, wherein the timing information includes a reference time corresponding to a time for impeding travel of the second vehicle along the second route through the crossing, the reference time being an absolute time.

2. The system of claim 1, wherein the communication module is configured to transmit the timing information before the first vehicle enters a range of an automatic closure module associated with the remote crossing module when the first vehicle is traveling at a speed that is slower than a reference speed, the reference speed corresponding to a speed for which the automatic closure module is configured to impede travel of the second vehicle along the second route through the crossing.

3. The system of claim 2, wherein the communication module is configured to transmit a suppression message to the remote crossing module, the suppression message configured to prevent operation of the automatic closure module when the first vehicle travels slower than the reference speed.

4. The system of claim 3, wherein the first route comprises plural sub-routes, and wherein the suppression information comprises sub-route identification information corresponding to a particular sub-route of the plural sub-routes on which the first vehicle is traveling.

5. The system of claim 1, wherein the first vehicle is an electric powered vehicle configured to receive energy from at least one of a rail or an overhead power source.

6. The system of claim 1, wherein the reference time is a time at which the first vehicle will enter the crossing.

7. The system of claim 1, wherein the reference time is a time at which a gate corresponding to the crossing is to be closed.

8. A system comprising:

a remote crossing module, the remote crossing module configured to be disposed along a first route along which a first vehicle is configured to travel, the first route comprising a track and a crossing corresponding to an intersection of the first route with a second route, the remote crossing module configured to impede travel of a second vehicle along the second route through the crossing when the first vehicle is proximate to the crossing on the first route, the remote crossing module comprising:

a communication module configured to communicatively couple the remote crossing module to the first vehicle, the communication module configured to receive timing information from the first vehicle, wherein the timing information includes a reference time corresponding to a time for impeding travel of the second vehicle along the second route through the crossing, wherein the reference time is configured as an absolute time; and a determination module configured to determine a closing time to impede travel of the second vehicle along the second route using the timing information;

wherein the remote crossing module is configured to control an automatic closure module configured to impede travel of the second vehicle along the second route using information obtained from a track detection system configured to detect signals sent via the track.

9. The system of claim 8, wherein the remote crossing module is configured to receive the timing information before the first vehicle enters a range of the automatic closure module when the first vehicle is traveling at a speed that is slower than a reference speed, the reference speed corresponding to a speed for which the automatic closure module is configured to impede travel of the second vehicle along the second route through the crossing, the timing information comprising a suppression message, wherein the remote crossing module is configured to suppress operation of the automatic closure module responsive to receiving the suppression message.

10. The system of claim 9, wherein the first route comprises plural sub-routes, and wherein the suppression message comprises sub-route identification information corresponding to a particular sub-route of the plural sub-routes on which the first vehicle is traveling, wherein the remote crossing module is configured to override the suppression message when the automatic crossing module receives information corresponding to a closing condition from a portion of the route other than the particular sub-route on which the first vehicle is traveling.

11. The system of claim 8, wherein the automatic closure module is configured to receive information from a crossing predictor detection system comprising a shunt positioned along the first route, the automatic closure module configured to impede travel along the second route through the crossing based on a speed and location of the first vehicle determined using the information from the crossing predictor detection system.

12. The system of claim 8, wherein the automatic closure module is configured to receive information from a track occupancy detection system, the automatic closure module configured to impede travel along the second route through the crossing based on a track occupancy.

13. The system of claim 8, wherein the closing time is configured as an absolute time.

14. A method comprising:

determining, at a processing unit disposed onboard a first vehicle configured to travel along a first route, timing information corresponding to a time at which the first vehicle will travel proximate to a crossing based on a speed and location of the first vehicle, the crossing corresponding to an intersection of the first route with a second route; and communicating the timing information to a remote crossing module disposed along the first route proximate the crossing, the remote crossing module configured to impede travel of a second vehicle along the second route through the crossing when the first vehicle is proximate to the crossing on the first route, wherein the timing information includes a reference time corresponding to a time for impeding travel of the second vehicle along the second route through the crossing, wherein the reference time is configured as an absolute time.

15. The method of claim 14, wherein the timing information is communicated to the remote crossing module before the first vehicle enters a range of an automatic closure module associated with the remote crossing module when the first vehicle is traveling at a speed that is slower than a reference speed, the reference speed corresponding to a speed for which the automatic closure module is configured to impede travel of the second vehicle along the second route through the crossing.

16. The method of claim 15, comprising communicating a suppression message to the remote crossing module, the suppression message configured to prevent operation of the automatic closure module.

17. The method of claim 16, wherein the first route comprises plural sub-routes, and wherein the suppression message comprises sub-route identification information corresponding to a particular sub-route of the plural sub-routes on which the first vehicle is traveling, the method further comprising overriding the suppression message when a different vehicle approaches the crossing on a portion of the first route other than the particular sub-route on which the first vehicle is traveling.

18. The method of claim 14, wherein the first vehicle is an electric powered vehicle configured to receive energy from at least one of a rail or an overhead power source.

19. The method of claim 14, wherein the reference time is a time at which the first vehicle will enter the crossing.

20. The method of claim 14, wherein the reference time is a time at which a gate corresponding to the crossing is to be closed.

* * * * *